US008447617B2

(12) United States Patent
Rossello et al.

(10) Patent No.: US 8,447,617 B2
(45) Date of Patent: May 21, 2013

(54) METHOD AND SYSTEM FOR SPEECH BANDWIDTH EXTENSION

(75) Inventors: Norbert Rossello, Biot (FR); Fabien Klein, Antibes (FR)

(73) Assignee: Mindspeed Technologies, Inc., Newport Beach, CA (US)

( * ) Notice: Subject to any disclaimer, the term of this patent is extended or adjusted under 35 U.S.C. 154(b) by 687 days.

(21) Appl. No.: 12/661,344

(22) Filed: Mar. 15, 2010

(65) Prior Publication Data

US 2011/0153318 A1 Jun. 23, 2011

Related U.S. Application Data

(60) Provisional application No. 61/284,626, filed on Dec. 21, 2009.

(51) Int. Cl.

| | |
|---|---|
| ***G10L 19/00*** | (2006.01) |
| ***G10L 11/06*** | (2006.01) |
| ***G10L 21/00*** | (2006.01) |
| ***G10L 19/02*** | (2006.01) |
| ***G10L 11/04*** | (2006.01) |
| ***G10L 11/00*** | (2006.01) |
| ***G10L 19/14*** | (2006.01) |

(52) U.S. Cl.
USPC ..... 704/500; 704/208; 704/219; 704/226; 704/229; 704/207; 704/200; 704/200.1; 704/205

(58) Field of Classification Search
USPC ..... 704/208, 219, 226, 229, 207, 200, 704/200.1, 205, 500
See application file for complete search history.

(56) References Cited

U.S. PATENT DOCUMENTS

| | | | | |
|---|---|---|---|---|
| 6,895,375 | B2 * | 5/2005 | Malah et al. | 704/219 |
| 7,359,854 | B2 * | 4/2008 | Nilsson et al. | 704/219 |
| 7,461,003 | B1 * | 12/2008 | Tanrikulu | 704/500 |
| 7,805,293 | B2 * | 9/2010 | Takada et al. | 704/205 |
| 2005/0108009 | A1 * | 5/2005 | Lee et al. | 704/229 |
| 2006/0277039 | A1 * | 12/2006 | Vos et al. | 704/219 |

(Continued)

FOREIGN PATENT DOCUMENTS

WO WO 02/056301 7/2002

OTHER PUBLICATIONS

Yasukawa, H: "Signal restoration of broadband speech using nonlinear processing", Signal Processing VIII, Theories and Applications. Proceedings of EUSIPCO-96, Eighth European Signal Processing Conference Edizioni Lint Trieste Trieste, Italy, vol. 2, 1996, pp. 987-990 vol. 2, XP002625600.

*Primary Examiner* — Edgar Guerra-Erazo
(74) *Attorney, Agent, or Firm* — Farjami & Farjami LLP

(57) ABSTRACT

There is provided a method or a device for extending a bandwidth of a first band speech signal to generate a second band speech signal wider than the first band speech signal and including the first band speech signal. The method comprises receiving a segment of the first band speech signal having a low cut off frequency and a high cut off frequency; determining the high cut off frequency of the segment; determining whether the segment is voiced or unvoiced; if the segment is voiced, applying a first bandwidth extension function to the segment to generate a first bandwidth extension in high frequencies; if the segment is unvoiced, applying a second bandwidth extension function to the segment to generate a second bandwidth extension in the high frequencies; using the first bandwidth extension and the second bandwidth extension to extend the first band speech signal beyond the high cut off frequency.

20 Claims, 10 Drawing Sheets

U.S. PATENT DOCUMENTS

2006/0282262 A1* 12/2006 Vos et al. ..... 704/219
2008/0300866 A1* 12/2008 Mukhtar et al. ..... 704/205
2009/0048846 A1 2/2009 Smaragdis
2010/0174535 A1* 7/2010 Vos et al. ..... 704/207
2011/0075855 A1* 3/2011 Oh et al. ..... 381/73.1
2012/0230515 A1* 9/2012 Grancharov et al. ..... 381/98

* cited by examiner

- Speech Bandwidth Extension (SBE or BWE) to enhance communications with legacy NB terminals up to wide band Voice Quality:

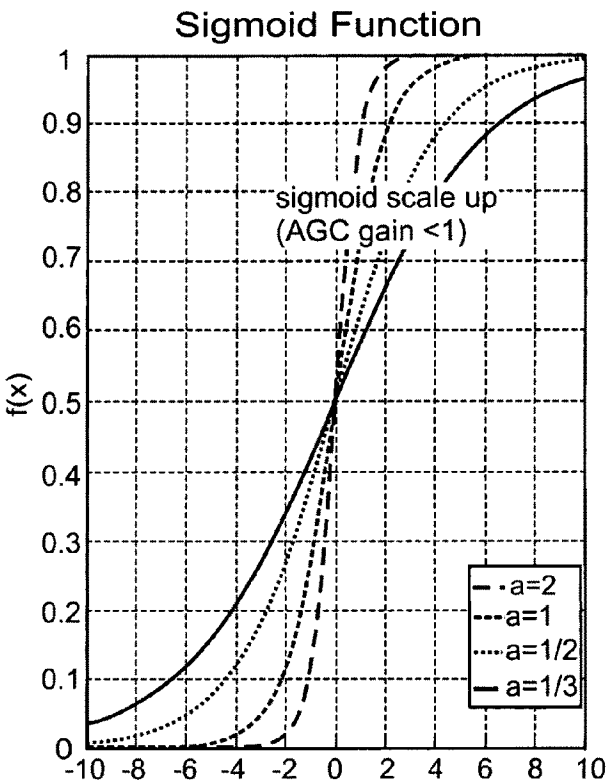
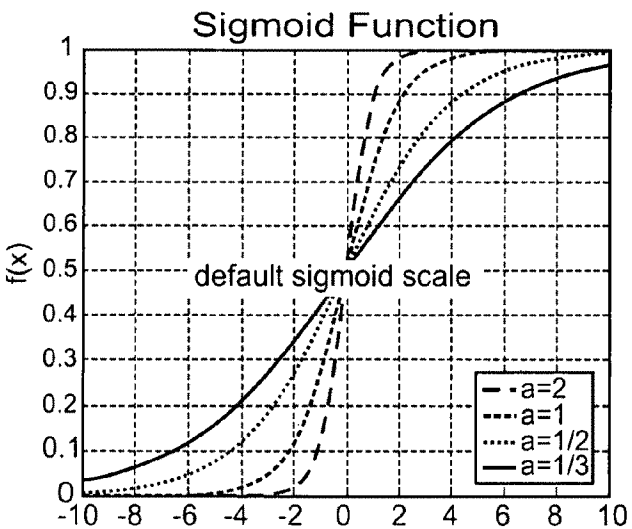
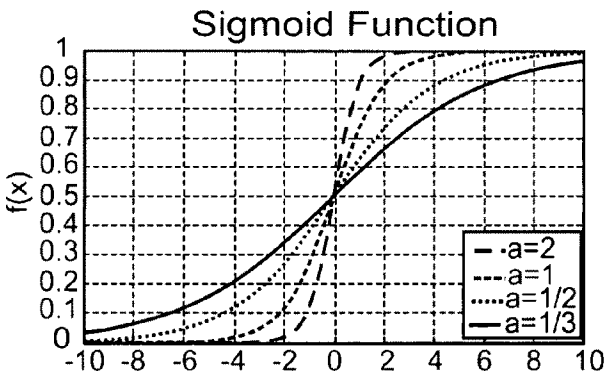
sigmoid scale down
(AGC gain >1)
FIG. 7-1

METHOD AND SYSTEM FOR SPEECH BANDWIDTH EXTENSION

RELATED APPLICATIONS

This application claims priority to U.S. Provisional Application No. 61/284,626, filed Dec. 21, 2009, which is hereby incorporated by reference in its entirety.

BACKGROUND OF THE INVENTION

1. Field of the Invention

The present invention relates generally to signal processing. More particularly, the present invention relates to speech signal processing.

2. Background Art

The VoIP (Voice over Internet Protocol) network is evolving to deliver better speech quality to end users by promoting and deploying wideband speech technology, which increases voice bandwidth by doubling sampling frequency from 8 kHz up to 16 kHz. This new sampling rate leads to include a new high band frequency up to 7.5 kHz (8 kHz theoretical) and will extend the speech low frequency region down to 50 Hz. This will result in an enhancement of speech naturalness, differentiation, nuance, and finally comfort. In other words, wideband speech allows more accuracy in hearing certain sounds, e.g. better hearing of fricative "s" and plosive "p".

The main applications that are being targeted to take advantage of this new technology are voice calls and conferencing, and multimedia audio services. Wideband speech technology aims to reach higher voice quality than legacy Carrier Class voice services based on narrowband speech having sampling frequency of 8 kHz and a frequency range of 200 Hz to 3400 (4 kHz theoretical.) As the legacy narrowband phone terminals were prioritizing the understandability of speech, the new trend of wideband phone terminals will improve the speech comfort. Wideband speech technology is also named as "High Definition Voice" (HD Voice) in the art.

FIG. 1 shows speech frequency band 100, which provides for a comparison between the wideband voice frequency bandwidth and the legacy traditional narrowband voice frequency bandwidth. As shown, the wideband voice frequency bandwidth extends from 50 Hz to 7.5 kHz, whereas the legacy traditional narrowband voice frequency bandwidth extends from 200 Hz to 3.4 kHz.

However, before the wideband speech can be fully deployed in infrastructure as network and terminals, an intermediate narrowband/wideband co-existence period will have to take place. Experts estimate the transition period from wideband to narrowband may take as long as several years because of the slowness to upgrading the infrastructure equipment to support wideband speech. In order to improve the speech quality during this intermediate period or in systems where narrowband and wideband speech co-exist, some signal processing researchers have proposed several models, which are mostly based on an extension mode of CELP speech coding algorithm. Unfortunately, the proposed models suffer from consumption of high processing power, while providing a limited performance improvement.

Accordingly, there is a need in the art to address the intermediate period of narrowband/wideband co-existence, and to further improve speech quality for systems, where narrowband and wideband speech co-exist, in an efficient manner.

SUMMARY OF THE INVENTION

There are provided systems and methods for speech bandwidth extension, substantially as shown in and/or described in connection with at least one of the figures, as set forth more completely in the claims.

BRIEF DESCRIPTION OF THE DRAWINGS

The features and advantages of the present invention will become more readily apparent to those ordinarily skilled in the art after reviewing the following detailed description and accompanying drawings, wherein.

DETAILED DESCRIPTION OF THE INVENTION

The present application is directed to a system and method for providing access to a virtual object corresponding to a real object. The following description contains specific information pertaining to the implementation of the present invention. One skilled in the art will recognize that the present invention may be implemented in a manner different from that specifically discussed in the present application. Moreover, some of the specific details of the invention are not discussed in order not to obscure the invention. The specific details not described in the present application are within the knowledge of a person of ordinary skill in the art. The drawings in the present application and their accompanying detailed description are directed to merely exemplary embodiments of the invention. To maintain brevity, other embodiments of the invention, which use the principles of the present invention, are not specifically described in the present application and are not specifically illustrated by the present drawings.

Various embodiments of the present invention aim to deliver speech signal processing systems and methods for VoIP gateways as well as wideband phone terminals in order to enhance the speech emitted by the legacy narrowband phone terminals up to a wideband speech signal, so as to improve wideband voice quality for new wideband phone terminals. The new and novel speech signal processing algorithms of various embodiments of the present invention may be called "Speech Bandwidth Extension" (which may use acronyms: SBE or BWE). In various embodiments of the present invention the narrow bandwidth speech is extended in high and low frequencies close to the original natural wideband speech. As a result, wideband phone terminals according to the present invention would receive a speech quality for a narrowband speech signal that a regular wideband phone terminal would receive for a wideband speech signal.

Figure 1:
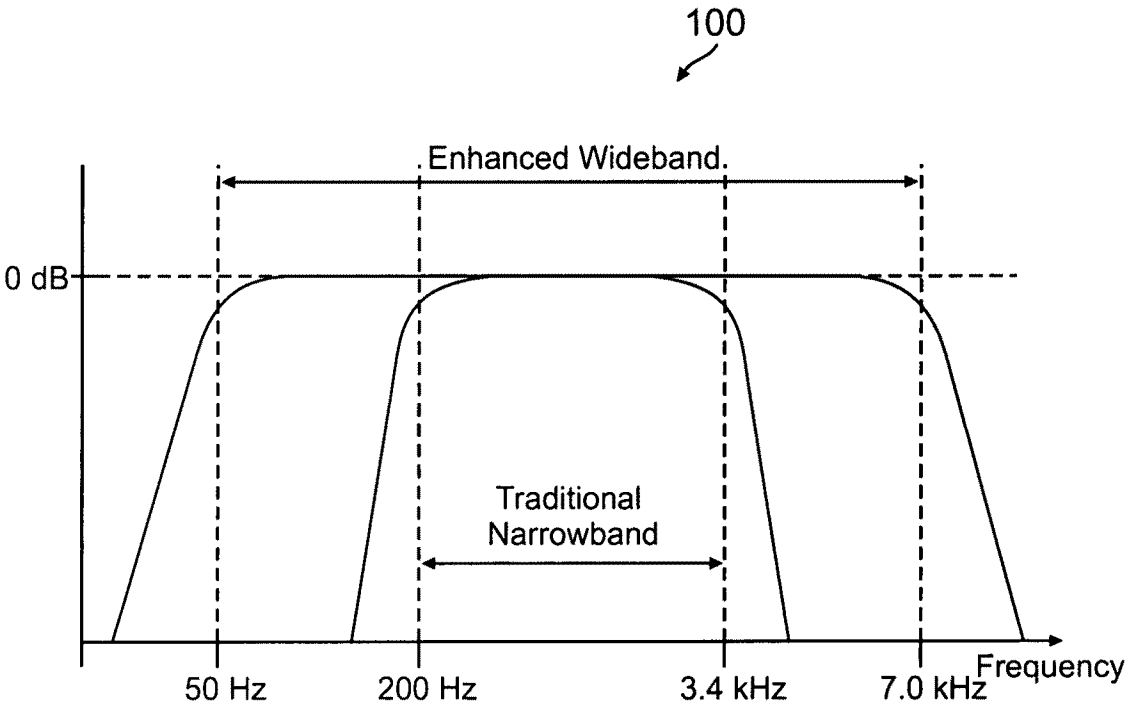
FIG. 1 illustrates a speech frequency band providing a comparison between wideband voice frequency bandwidth and narrowband voice frequency bandwidth.
Figure 2:
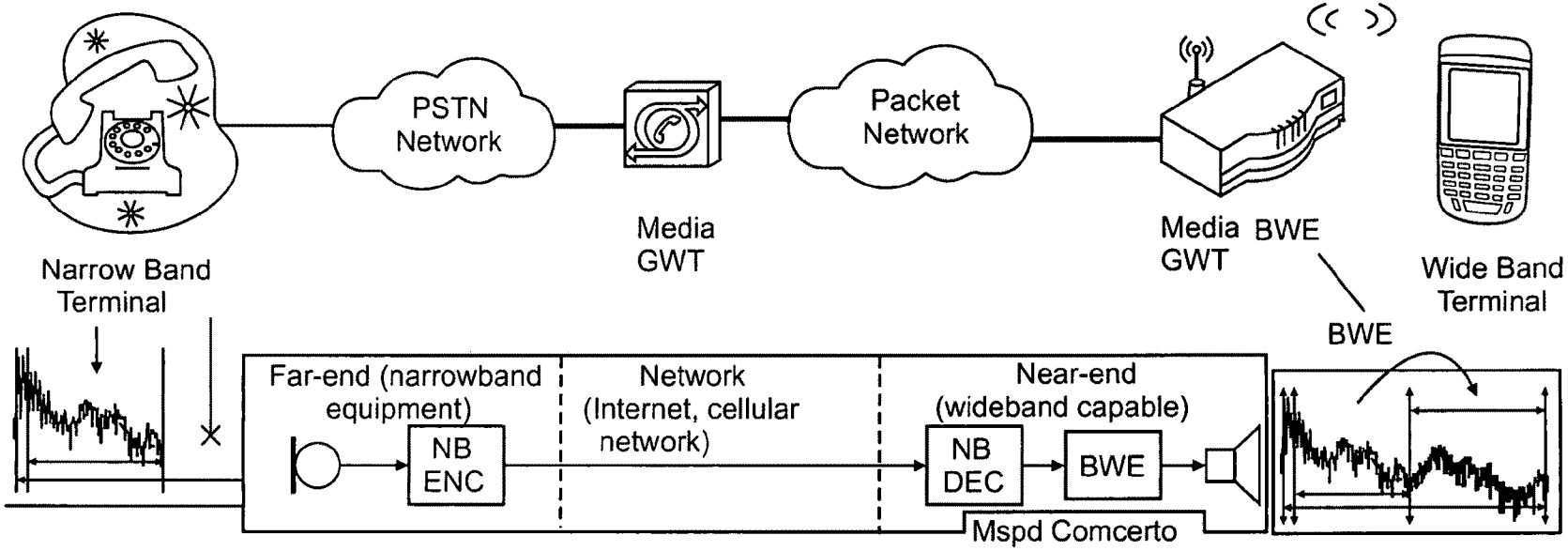
FIG. 2 illustrates a speech signal flow in a communication system from narrowband terminal to wideband terminal, where a speech bandwidth extension is applied, according to one embodiment of the present invention.

FIG. 2 illustrates a speech signal flow in communication system 200 from narrowband terminal 205 to wideband terminal 230, where the speech bandwidth extension of the present invention may take place. As shown in FIG. 2, communication system 200 includes narrowband terminal 205, which can be a regular narrowband POTS (Plain Old Telephone System) phone having a microphone for receiving speech signals. A first frequency spectrum shows first narrowband speech signals 201 in frequency range of 200 Hz to 3400 Hz, and a second frequency spectrum shows no first wideband speech signals 202A and 202B in frequency range of 50-200 Hz and 3400-7500 Hz. First narrowband speech signals 201 travel through PSTN network 210 and arrive at first media gateway 215, where first narrowband speech signals 201 are encoded using narrowband encoder 216 to generated encoded narrowband signals using a speech coding technique, such as G.711, G.729, G.723.1, etc. Encoded narrowband signals are then transported across packet network 220, and arrive at second media gateway 225, where narrowband decoder 225 decodes the encoded narrowband signals to synthesize or regenerate first narrowband speech signals 201 and provide a synthesized narrowband speech signals. At this point, according to one embodiment of the present invention, second media gateway 225 applies a bandwidth extension algorithm to synthesized narrowband speech signals to generate second narrowband speech signals 228 in frequency range of 200 Hz to 3400 Hz, and second wideband speech signals 229A and 229B in frequency range of 50-200 Hz and 3400-7500 Hz, respectively. Thereafter, speech signals in a frequency range of 50-7500 Hz are provided to wideband terminal 230 for playing to a user through a speaker. Although the bandwidth extension algorithm of the present invention is described as being applied at second media gateway 225, the bandwidth extension algorithm could be applied by any computing device, including second media gateway 225, prior to the voice signals being played by wideband terminal 230.

Figure 3:
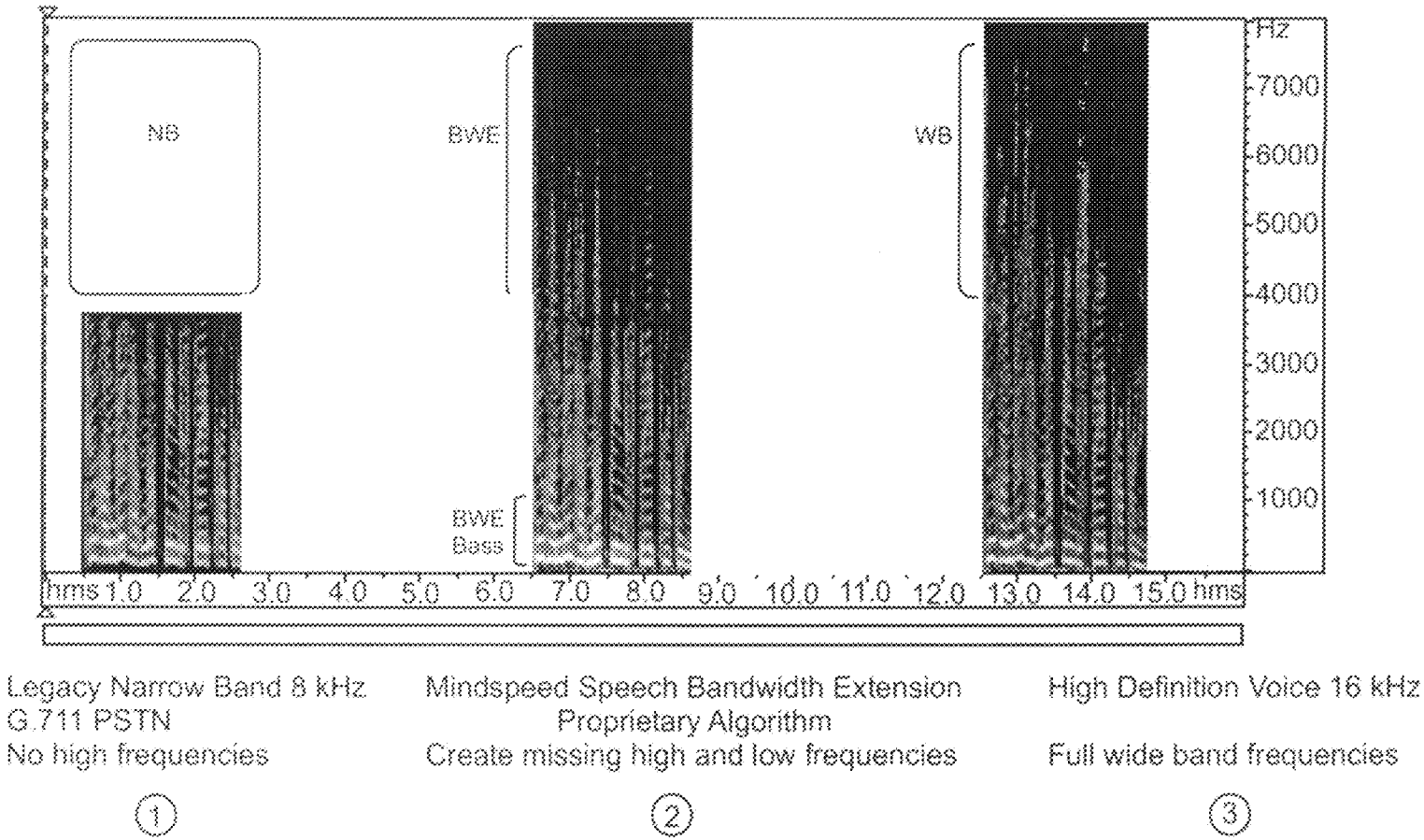
FIG. 3 illustrates a speech bandwidth extension in spectrogram, according to one embodiment of the present invention.

FIG. 3 illustrates a speech bandwidth extension of the present invention in spectrogram. First area 310 shows legacy terminal transmission of narrow band signals at 8 kHz. Second area 320 shows creation of a speech bandwidth extension, according to one embodiment of the present invention, where high frequency bandwidth extension 317 and low frequency bandwidth extension 319 extend the narrow band signals in first area 310. In one embodiment of the present invention, the speech bandwidth extension algorithm may only create high frequency bandwidth extension 317, and not low frequency bandwidth extension 319. Third area 320 shows full wide band frequencies at 16 kHz for comparison purposes with first area 310.

Figure 4:
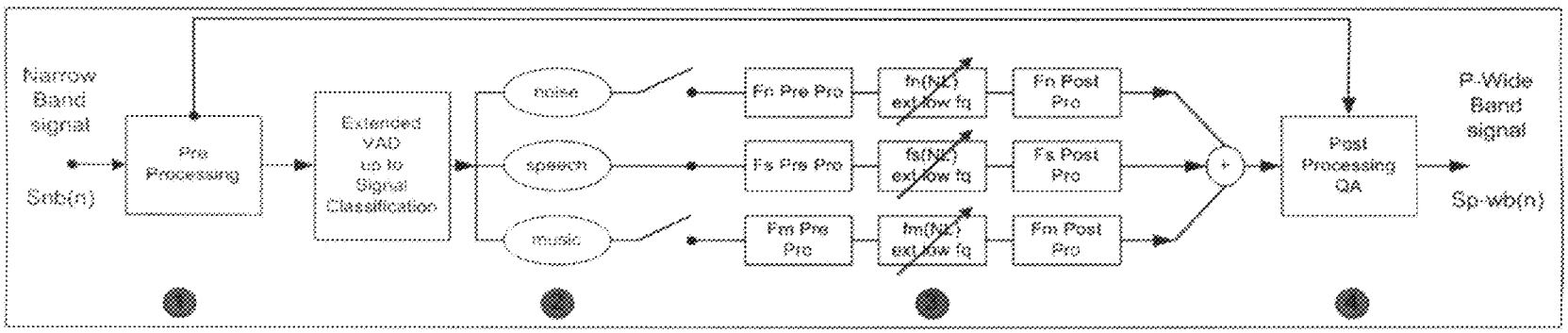
FIG. 4 illustrates various elements or steps of bandwidth extension that may be applied to narrowband signals in a speech bandwidth extension system, according to one embodiment of the present invention.

FIG. 4 illustrates various elements or steps of bandwidth extension that may be applied to narrowband signals in speech bandwidth extension system 400. Any of such elements or steps may be implemented in hardware or software using a controller, microprocessor or central processing unit (CPU), such as being implemented in Mindspeed Comcerto device, which leverages ARM's core technology.

For ease of discussion, speech bandwidth extension system 400 is depicted and described in four main elements or steps. The four elements or steps are (1) pre-processing (410) element or step for locating signals cut off low and high frequencies; (2) signal classifier (420) element or step for optimized extension, so as to distinguish noise/unvoiced, voice and music, in one embodiment of the present invention; (3) optimized adaptive signal extension (430) element or step for low and high frequencies; and (4) short and long term post processing (440) element or step for final quality assurance, such as a smooth merger with narrow band signals; equalization and gain adaptation.

Turning to pre-processing (410) element or step, in one embodiment, includes a low pass filter between [0, 300] Hz that can detect the presence or absence of low frequency speech signals, and a high pass filter above 3200 Hz that can detect the presence or absence of high frequencies. Detection or location of the narrowband signals cut off at low and high frequencies can use for further processing at short and long term post processing (440) element or step, as explained below, for joining or connecting extended bandwidth signals at low and high frequencies to the existing narrowband signals. For example, at low frequencies, it may be determined where the signal is attenuated between 0-300 Hz, and high frequencies, it may be determined where the frequency cut off occurs between 3,200-4,000 Hz.

Regarding signal classifier (420) element or step, as explained above, in one embodiment, an enhanced voice activity detector (VAD) may be used to discriminate between noise, voice and music. In other embodiments, a regular VAD can be used to discriminate between noise and voice. The VAD may also be enhanced to use energy, zero crossing and tilt of spectrum to measure flatness of spectrum, to further provide for a smoother switching such that voice does not cut off suddenly for transition to noise, e.g. overhang period for voice may be extended.

Now, optimized adaptive signal extension (430) element or step can be divided into a high frequencies extension element or step and a low frequencies extension element.

As for the high frequencies extension element or step, the signal processing theoretical basis is explained as follows. In an embodiment of the present invention, for speech bandwidth extension in high frequencies non-linear signal components mapped into frequency domain are exploited. If we designate the linear 16-bit sampled signal "x(n) for n=0 . . . N" by "x" to simplify notation:

$$\forall n \in [0, N], x(n) \leftarrow x$$

The signal "x", which designates the narrowband signal, is mapped into the interval value of [−1, 1] or interval of absolute value of [0, 1]:$|x| \leqq 1$ which is then transformed by a function f(x) of values as well in [−1, 1].

According to Taylor's series f(x) can be than developed into linear combination of power of x by its limited development:

$$f(x) = g(x^n) = \sum_{n=0}^{\infty} \alpha_n x^n$$

Taking benefit of the linearity of the Fourier transform, it follows:

$$TF(f(x)) = TF(g(x^n) = \sum_{n=0}^{\infty} \alpha_n TF(x^n) = \sum_{n=0}^{\infty} \beta_n F(e^{jn\theta})$$

in which the $F(e^{jn\Theta})$ functions are bringing the new frequencies and especially the high frequencies needed for the speech bandwidth extension.

Figure 5:
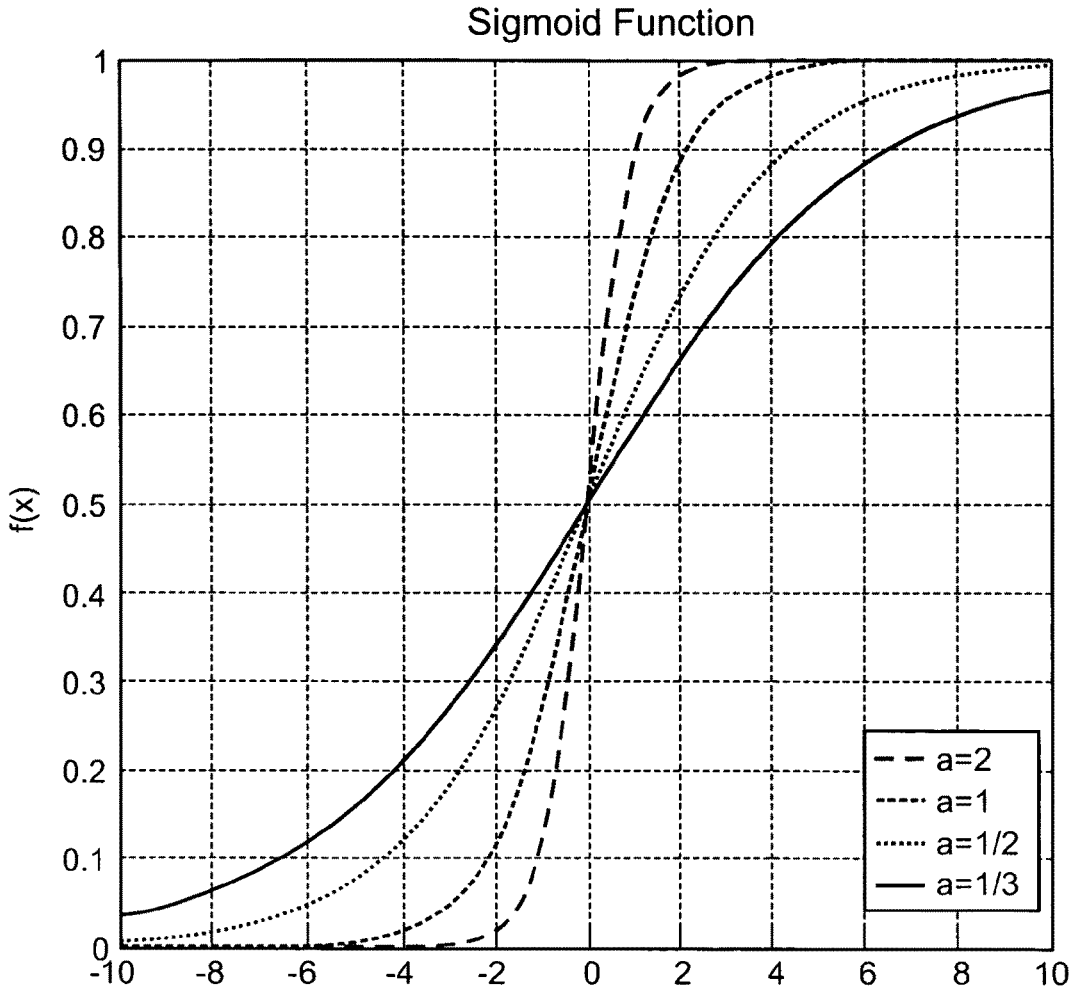
FIG. 5 illustrates a theoretical shape of sigmoid function that is used for high frequencies bandwidth extension, according to one embodiment of the present invention.
Figure 6:
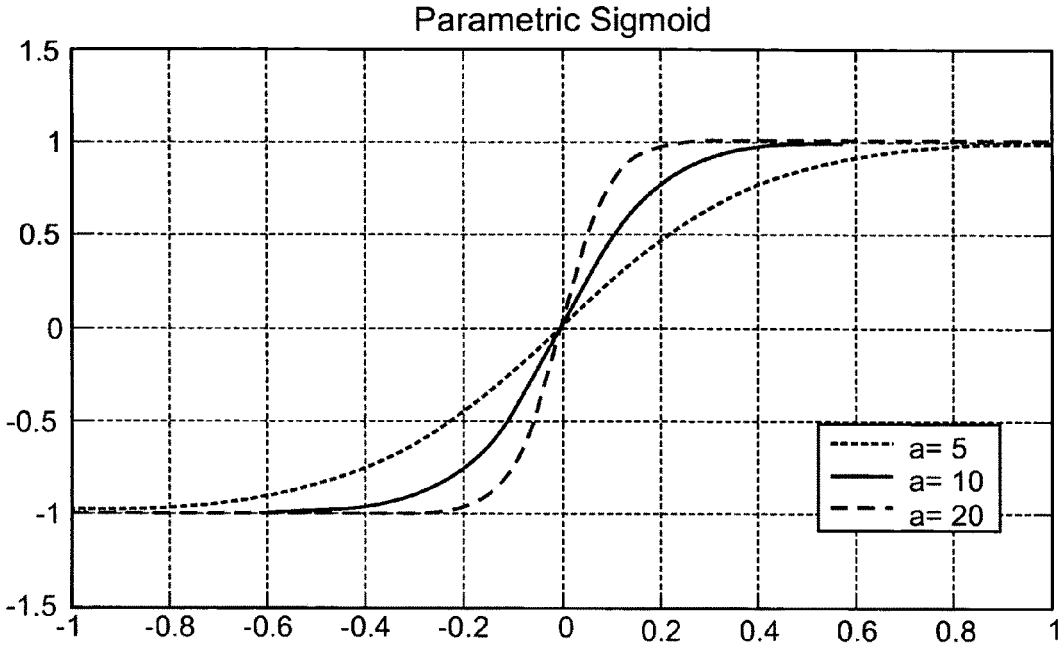
FIG. 6 illustrates a normalized shape of sigmoid function where the axes in FIG. 5 are normalized and centered for mapping the expected interval, according to one embodiment of the present invention.

The choice of function "f(x)" applied to signal is also important, and for voiced frames or voiced speech segments, in one embodiment of the present invention, a sigmoid function, is applied:

$$f(x) = \left(\frac{1}{1 + e^{ax}}\right)$$

for which, the theoretical shape, is shown in FIG. 5, in function of parameter 'a', where the axes should be normalized and centered for mapping the expected [−1, 1] interval as shown in FIG. 6.

At this point, for example, a centered and sigmoid of exponential scaling of a=10, is applied:

$$f_{sigmoid}(x) = \left(\frac{1}{1 + e^{ax}} - \frac{1}{2}\right) \times 2$$

Figure 7:
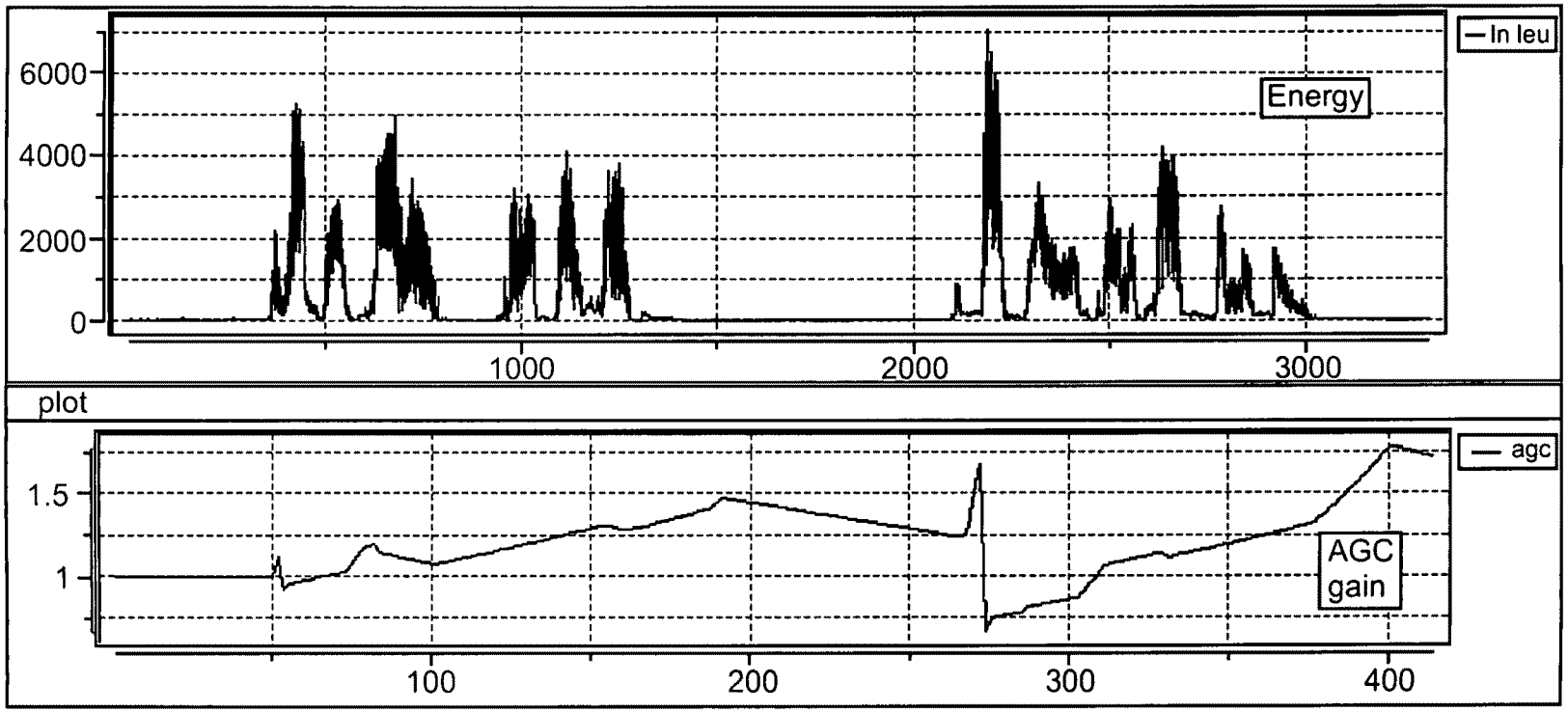
FIG. 7 illustrates a dynamically scaled sigmoid providing optimal harmonics generation, according to one embodiment of the present invention.

In order to provide a significant amount of new frequencies regardless of the input signal amplitude, i.e. small values fall into limited non linear part of the sigmoid, whereas high values should avoid falling into the higher non linear part, an embodiment of the present invention utilizes instantaneous gain provided by an Automatic Gain Control (AGC) to dynamically scale the sigmoid and get the optimal harmonics generation, as depicted in FIG. 7.

In one embodiment of the present invention, for unvoiced frames or unvoiced speech segment, a different function than the one for voiced speech segment is applied, which is the following function:

For $x \geqq 0$:

$$f_{poly}(x) = \sum_{i=0}^{P} p_i x^i \text{ with } 0 < p_i < P$$

In practice, one may select:

$p_0 \approx 0,\ 1 < p_1 < 2,\ p_{i>1} << p_1$

For $x<0$:

$f_{poly}(x) = x$

Next, both results of transformed f(x) may be finally adaptively mixed with a programmable balance between the two components in order to avoid phase discontinuity (artifact) and to deliver a smooth extended speech signal:

$$F_{Final}(x) = (q(v) \times f_{sigmoid}(x) + (1 - q(v)) \times f_{xp}(x)$$

The adaptive balance may be defined by:

$q(v) \in [0,1]$

With the coefficient "v" determining the mixture in function of the voiced profile of speech signal from the VAD combining energy, zero crossing and tilt measurement:

$q(v(E-VAD,t)) \in [0,1]$

In one embodiment, for voiced speech segment q(v) of 50% may be chosen for equivalent contribution from sigmoid or poly functions, and for unvoiced speech segment (also called fricative) q(v) of 10% may be chosen for affording greater contribution from the polynomial function. Of course, the values of 50% and 10% are exemplary. Also, a time parameter 't' can be used to smooth transition from the two previous states.

It should also be noted that at least in one embodiment in which the VAD detects a music signal, then a function different than those of voiced and unvoiced speech signals will be used to improve the music quality.

Turning to the low frequencies extension, the presence of low frequencies in the narrow band signals is primarily identified according to a spectral analysis. Next, an equalizer applies an adaptive amplification to low frequencies to compensate for the estimated attenuation. This processing allows the low frequencies to be recovered from network attenuation (Ref. to ideal ITU P.830 MIRS model) or terminal attenuation.

With respect to the fourth element or step of short-term and long-term post processing (404) is utilized for joining the new extended high frequencies in wideband areas, e.g. wideband signals 229A and 229B of FIG. 2, to the existing narrowband signals, e.g. narrowband signals 228 of FIG. 2, using an adaptive high-pass filter. This post-processing step or element 404 utilizes the results of the first element or step of frequencies cut off detection 401 to determine the presence and boundary of high frequencies in the narrowband signal is first identified, as described above, and uses elliptic filtering in one embodiment. In a preferred embodiment, the wideband high frequency signal joins the original narrowband at its maximum or cut off to keep the original signal frequencies intact. Further, the signal level of the bandwidth extended signal is maintained subject to limited variation, such as 4-5 dB.

Figure 8:
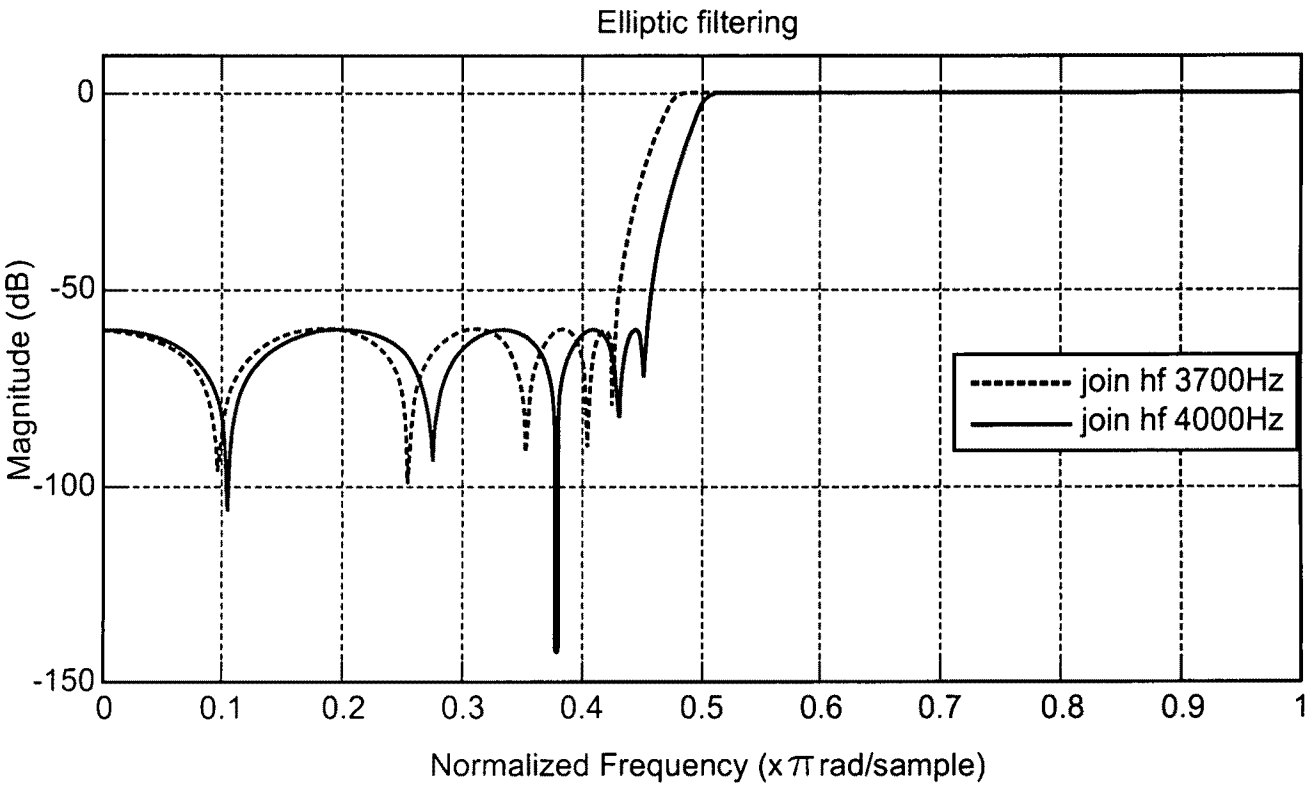
FIG. 8 illustrates an example of high-pass filter for 3700 Hz and 4000 Hz for controlling the new extended speech signal energy into defined boundaries, according to one embodiment of the present invention.
Figure 9:
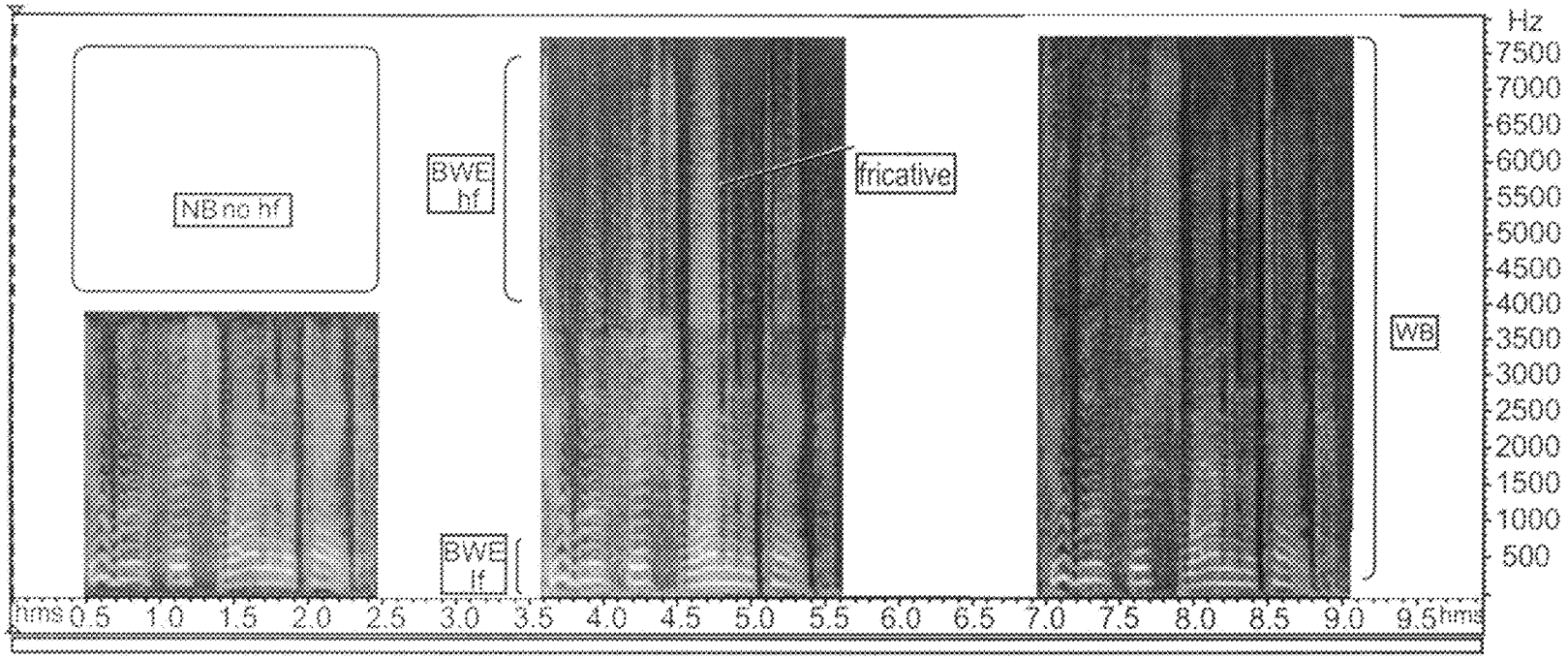
FIG. 9 illustrates a speech bandwidth extended signal area generated according to one embodiment of the present invention, which is placed in between a narrowband speech signal area and a pure wide band speech signal for comparison purposes.

FIG. 8 provides an example of high-pass filter for 3700 Hz and 4000 Hz. Before final delivery of the speech bandwidth extended signal to the wideband terminal, the speech signal may be passed through an adaptive energy gain to control the new extended speech signal energy into defined boundaries, such as 4-5 dB. The complete and final speech bandwidth extension of an embodiment of the present invention is shown in FIG. 9 in speech bandwidth extended signal area 920 placed in between narrowband speech signal area 910 and pure wide band speech signal 930 for comparison purposes.

Thus, various embodiments of the present invention create high frequency and recovers low frequency spectrum based on existing narrowband spectrum closely matching a pure wideband speech signal, and provide low complexity for minimizing voice system density, e.g. smaller than the CELP codebook mapping extension model, and offer flexible extension from voice up to noise/music for covering voice and audio. It should be further noted that the bandwidth extension of the present invention would also apply to next generation of wide band speech and audio signal communication as Super wide band with sampling frequencies of 14 kHz, 20 kHz, 32 kHz up to Ultra wide band of 44.1 kHz known as "Hi-Fi Voice". In other words, a first band speech/audio may be extended to a second band speech/audio, where the second band speech/audio is wider than the first band speech/audio and includes the first band speech/audio.

From the above description of the invention it is manifest that various techniques can be used for implementing the concepts of the present invention without departing from its scope. Moreover, while the invention has been described with specific reference to certain embodiments, a person of ordinary skills in the art would recognize that changes can be made in form and detail without departing from the spirit and the scope of the invention. As such, the described embodiments are to be considered in all respects as illustrative and not restrictive. It should also be understood that the invention is not limited to the particular embodiments described herein, but is capable of many rearrangements, modifications, and substitutions without departing from the scope of the invention.

What is claimed is:

1. A method of extending a bandwidth of a first band speech signal to generate a second band speech signal wider than the first band speech signal and including the first band speech signal, the method comprising:

receiving a segment of the first band speech signal having a low cut off frequency and a high cut off frequency;

determining the high cut off frequency of the segment of the first band speech signal;

determining whether the segment of the first band speech signal is voiced or unvoiced;

if the segment of the first band speech signal is voiced, applying a first bandwidth extension function to the segment of the first band speech signal to generate a first bandwidth extension in high frequencies;

if the segment of the first band speech signal is unvoiced, applying a second bandwidth extension function to the segment of the first band speech signal to generate a second bandwidth extension in the high frequencies;

using the first bandwidth extension and the second bandwidth extension to extend the first band speech signal beyond the high cut off frequency.

2. The method of claim 1 further comprising:

determining the low cut off frequency of the segment of the first band speech signal;

amplifying low frequencies below the low cut off frequency of the segment of the first band speech signal to generate a bandwidth extension in low frequencies;

using the bandwidth extension in the low frequencies to extend the first band speech signal below the low cut off frequency.

3. The method of claim 1 further comprising:

determining whether the segment of the first band speech signal is voiced, unvoiced or music;

if the segment of the first band speech signal is music, applying a third bandwidth extension function to the segment of the first band speech signal to generate a third bandwidth extension in the high frequencies.

4. The method of claim 1, wherein using the first bandwidth extension and the second bandwidth extension uses a different portion of the first bandwidth extension and the second bandwidth extension based on whether the segment of the first band speech signal is voiced or unvoiced.

5. The method of claim 1, wherein the first bandwidth extension function is defined by:

$$f(x) = \left(\frac{1}{1 + e^{\alpha x}}\right),$$

where x is the first band speech signal.

6. The method of claim 5, wherein the second bandwidth extension function is defined by:

For $x \geqq 0$:

$$f_{poly}(x) = \sum_{i=0}^{P} p_i x^i \text{ with } 0 < p_i < P$$

In practice, one may select:

$p_0 \approx 0,\ 1 < p_1 < 2,\ p_{i>1} \ll p_1$

For $x < 0$:

$f_{poly}(x) = x$ where x is the first band speech signal.

7. The method of claim 6, wherein using the first bandwidth extension and the second bandwidth extension includes adaptively mixing the first bandwidth extension and the second bandwidth extension using:

$$F_{Final}(x) = (q(v) \times f_{sigmoid}(x) + (1 - q(v)) \times f_{xp}(x)$$

where an adaptive balance may be defined by:

$q(v) \in [0,1]$ where coefficient "v" determines a mixture of each function.

8. The method of claim 7, wherein for the voiced speech segment q(v) of 50% is chosen for equivalent contribution from the first bandwidth extension function and the second bandwidth extension function.

9. The method of claim 7, wherein for the unvoiced speech segment q(v) of 10% is chosen for affording greater contribution from the second bandwidth extension function.

10. The method of claim 1, wherein the second bandwidth extension function is defined by:

For $x \geqq 0$:

$$f_{poly}(x) = \sum_{i=0}^{P} p_i x^i \text{ with } 0 < p_i < P$$

In practice, one may select:

$p_0 \approx 0,\ 1 < p_1 < 2,\ p_{i>1} \ll p_1$

For $x < 0$:

$f_{poly}(x) = x$ where x is the first band speech signal.

11. A device for extending a bandwidth of a first band speech signal to generate a second band speech signal wider than the first band speech signal and including the first band speech signal, the device comprising:

a pre-processor configured to receive a segment of the first band speech signal having a low cut off frequency and a high cut off frequency, and to determine the high cut off frequency of the segment of the first band speech signal;

a voice activity detector configured to determine whether the segment of the first band speech signal is voiced or unvoiced;

a processor configured to:

if the segment of the first band speech signal is voiced, apply a first bandwidth extension function to the segment of the first band speech signal to generate a first bandwidth extension in high frequencies;

if the segment of the first band speech signal is unvoiced, apply a second bandwidth extension function to the segment of the first band speech signal to generate a second bandwidth extension in the high frequencies;

use the first bandwidth extension and the second bandwidth extension to extend the first band speech signal beyond the high cut off frequency.

12. The device of claim 11, wherein:

the pre-processor is further configured to determine the low cut off frequency of the segment of the first band speech signal; and the processor is further configured to:

amplify low frequencies below the low cut off frequency of the segment of the first band speech signal to generate a bandwidth extension in low frequencies; and use the bandwidth extension in the low frequencies to extend the first band speech signal below the low cut off frequency.

13. The device of claim 11, wherein:

the voice activity detector is further configured to determine whether the segment of the first band speech signal is voiced, unvoiced or music; and the processor is further configured to:

if the segment of the first band speech signal is music, apply a third bandwidth extension function to the segment of the first band speech signal to generate a third bandwidth extension in the high frequencies.

14. The device of claim 11, wherein the processor is configured to use a different portion of the first bandwidth extension and the second bandwidth extension based on whether the segment of the first band speech signal is voiced or unvoiced.

15. The device of claim 11, wherein the first bandwidth extension function is defined by:

$$f(x) = \left(\frac{1}{1 + e^{\alpha x}}\right),$$

where x is the first band speech signal.

16. The device of claim 15, wherein the second bandwidth extension function is defined by:

For $x \geqq 0$:

$$f_{poly}(x) = \sum_{i=0}^{P} p_i x^i \text{ with } 0 < p_i < P$$

In practice, one may select:

$p_0 \approx 0,\ 1 < p_1 < 2,\ p_{i>1} \ll p_1$

For $x < 0$:

$f_{poly}(x) = x$ where x is the first band speech signal.

17. The device of claim 16, the processor is configured to adaptively mix the first bandwidth extension and the second bandwidth extension using:

$$F_{Final}(x) = (q(v) \times f_{sigmoid}(x) + (1 - q(v)) \times f_{xp}(x)$$

where an adaptive balance may be defined by:

$q(v) \in [0,1]$ where coefficient "v" determines a mixture of each function.

18. The device of claim 17, wherein for the voiced speech segment the processor is configured to choose q(v) of 50% for equivalent contribution from the first bandwidth extension function and the second bandwidth extension function.

19. The device of claim 17, wherein for the unvoiced speech segment the processor is configured to choose q(v) of 10% for affording greater contribution from the second bandwidth extension function.

20. The device of claim 11, wherein the second bandwidth extension function is defined by:

For $x \geqq 0$:

$$f_{poly}(x) = \sum_{i=0}^{P} p_i x^i \text{ with } 0 < p_i < P$$

In practice, one may select:

$p_0 \approx 0,\ 1 < p_1 < 2,\ p_{i>1} \ll p_1$

For $x < 0$:

$f_{poly}(x) = x$ where x is the first band speech signal.

* * * * *